US005239145A

United States Patent [19]

Kusakabe

[11] Patent Number: 5,239,145

[45] Date of Patent: Aug. 24, 1993

[54] PIN JACK

[75] Inventor: Toshihito Kusakabe, Ibaragi, Japan

[73] Assignee: Hosiden Corporation, Yao, Japan

[21] Appl. No.: 815,584

[22] Filed: Dec. 30, 1991

Related U.S. Application Data

[63] Continuation of Ser. No. 627,762, Dec. 14, 1990.

[30] Foreign Application Priority Data

Jan. 10, 1990 [JP] Japan ..... 2-1580[U]

[51] Int. Cl.[5] ..... H01H 13/70

[52] U.S. Cl. ..... 200/51.1; 200/51.008; 200/51.013

[58] Field of Search ..... 200/51.1, 51.12, 51.09, 200/51.13, 51.08

[56] References Cited

U.S. PATENT DOCUMENTS

| | | | |
|---|---|---|---|
| 3,383,481 | 5/1968 | Bailey et al. | 200/51.1 |
| 4,633,048 | 12/1986 | Komatsu | 200/51.1 |
| 4,778,240 | 10/1988 | Komatsu | 200/51.1 |
| 4,937,404 | 6/1990 | Kitagawa | 200/51.1 |

*Primary Examiner*—Henry J. Recla
*Assistant Examiner*—David J. Walczak
*Attorney, Agent, or Firm*—Jones, Tullar & Cooper

[57] ABSTRACT

A pin jack comprised of a casing body having an insertion space for receiving a plug member. A contact assembly comprising a fixed piece, a connecting piece and a moveable contact piece assembled within the insertion space of the casing body. The members of the contact assembly are arranged laterally in the insertion space of the casing body thus reducing the overall length of the pin jack. The contact assembly can be formed from a single piece of electrically conductive material.

6 Claims, 3 Drawing Sheets

PIN JACK

This is a continuation of co-pending application Ser. No. 07/627,762 filed on Dec. 14, 1990.

BACKGROUND OF THE INVENTION

1. Field of the Invention

The present invention relates to a pin jack to be mounted on an electric appliance such as a video camera or the like.

The pin jack of the type above-mentioned generally comprises (i) a casing body forming an electrical plug insertion space (hereinafter referred to as the plug insertion space) into which an electrical plug serving as the counter member for this pin jack (hereinafter referred to as plug) is to be inserted, and (ii) a movable contact piece adapted to resiliently come in contact with the plug. When the plug is inserted into the plug insertion space in the casing body, the contact formed on the plug resiliently comes in contact with the contact of the movable contact piece.

2. Description of the Prior Art

The pin jack of the prior art of the type above-mentioned is described in Japanese Utility Model Laid-Open Publication No 61-4378. As shown in FIG. 4, this conventional pin jack comprises a movable contact piece 100, a stationary piece 110 integral with the movable contact piece 100, a casing body 210 forming, in its inside, a plug insertion space, a stationary piece housing portion 220 integrally formed at the rear end of the casing body 210. The stationary piece 110 integrally extends from the base end of the movable contact piece 100 rearwardly thereof and is provided at a suitable portion thereof with an engagement pawl 111.

In the pin jack in FIG. 4, the movable contact piece 100 is assembled in the inside of the casing body 210 such that the longitudinal direction shown by an arrow A) of the movable contact piece 100 extends along the longitudinal direction (axial direction shown by an arrow B) of the casing body 210. In this assembled state, the stationary piece 110 is inserted into grooves 221 of the contact piece housing portion 220 and the engagement pawl 111 is engaged with a suitable portion of the inner surface of the stationary piece housing portion 220.

According to this pin jack, the movable contact piece 100 is positioned inside of the casing body 210 by both the stationary piece inserted into the stationary piece housing portion 220 and the engagement pawl engaged with the inner surface of the stationary piece housing portion 220.

In the pin jack above-mentioned, the movable contact piece 100 is assembled in the inside of the casing body 210 such that the longitudinal direction (shown by the arrow A) of the movable contact piece 100 extends along the longitúdinal direction (shown by the arrow B) of the casing body 210. In this pin jack, when the stationary piece 110 rearwardly extends from the base end of the movable contact piece 100, it is inevitably required that the stationary piece housing portion 220 for fixing the stationary piece 110 to position the movable contact piece 100 is integrally formed at the rear end of the casing body 210. In addition, the movable contact piece 100 is required to be long enough to provide suitable resiliency is given thereto. As to the stationary piece 110, it is required that, when fixed to the stationary piece housing portion 220, the stationary piece 110 should be firmly fastened and the stationary piece 110 should have such length (projecting length from the base end of the movable contact piece 100) as to assure a predetermined attaching strength.

However, if the lengths of the movable contact piece 100 and the stationary piece 110 are so determined as to satisfy the requirements above-mentioned, the entire length of the structure including both the movable contact piece 100 and the stationary piece 110 is lengthened. This inevitably lengthens the required length of the jack body 200 including the stationary piece housing portion 220 and the casing body 210 which houses the movable contact piece 100 and the stationary piece 110.

In a recent AV appliance such as a video camera, a stereo set or the like, it is required to reduce the entire configuration in size and to increase the mounting density of a variety of electric or electronic components. In this connection, the pin jack above-mentioned is also strongly required to be made in a compact design.

SUMMARY OF THE INVENTION

The present invention is proposed in view of the foregoing.

It is an object of the present invention to provide a pin jack in which an ingenious contrivance is made on the arrangement of the movable contact piece and the stationary piece such that the length of the movable contact piece is sufficiently lengthened to assure a suitable resiliency required for the movable contact piece, and that the length of the stationary piece is lengthened to enable the stationary piece to be strongly and securely assembled yet allowing a shortening of the length of the jack body including a casing body, so that the pin jack is made in a compact design.

It is another object of the present invention to provide a pin jack in which the movable contact piece is further securely assembled, assuring that the movable contact piece is displaced in a proper form.

It is a further object of the present invention to provide a pin jack having a switching function while allowing the pin jack to be made in a compact design.

To achieve the objects above-mentioned, a pin jack in accordance with the present invention comprises: a casing body made of an insulating material in which an electrical plug insertion space is formed; a movable contact piece disposed inside of the casing body such that the longitudinal direction of the movable contact piece extends along the longitudinal direction of the casing body, the movable contact piece being adapted to resiliently come in contact with a plug inserted into the electrical plug insertion space; a connection piece laterally extending from the base end of the movable contact piece; and a stationary piece disposed laterally of the movable contact piece and formed integrally with the connection piece, the stationary piece being secured to the inner wall of the casing body for positioning the movable contact piece at a predetermined position in the casing body.

According to the pin jack having the arrangement above-mentioned, since the movable contact piece and the stationary piece as assembled in the casing body are disposed side by side, it is possible to shorten the length of the jack body as compared with the conventional pin jack in which the stationary piece rearwardly extends from the rear end of the movable contact piece, yet allowing sufficient length for the movable contact piece or the stationary piece. Accordingly, even though the movable contact piece is sufficiently lengthened to assure a suitable resiliency and the stationary piece is sufficiently lengthened to be securely assembled with the jack body, the jack body, including the casing body, may be shortened in length. This enables the pin jack to be made in a compact design.

According to the present invention, the stationary piece may have a cut-raised engagement pawl, which is engaged with a stepped portion formed in the casing body, and both ends of the connection piece may be held, as fitted in, by and between fitting grooves formed in the casing body.

According to the pin jack above-mentioned, the movable contact piece is securely positioned at a predetermined position inside of the casing body by the stationary piece. Accordingly, when a plug is inserted into the plug insertion space, the movable contact piece may be displaced, without being twisted. This stabilizes the contact pressure applied to the movable contact piece and the plug.

According to the present invention, the casing body may be assembled with a stationary contact piece having a switch contact with which the tip portion of the movable contact piece comes in contact when a plug is not inserted into the plug insertion space in the casing body, and from which the movable contact piece is separated when a plug is inserted into the plug insertion space to displace the movable contact piece.

The pin jack above-mentioned may have a switching function and still allow the pin jack to be made in a compact design.

DETAILED DESCRIPTION OF THE PREFERRED EMBODIMENTS

Figure 1:
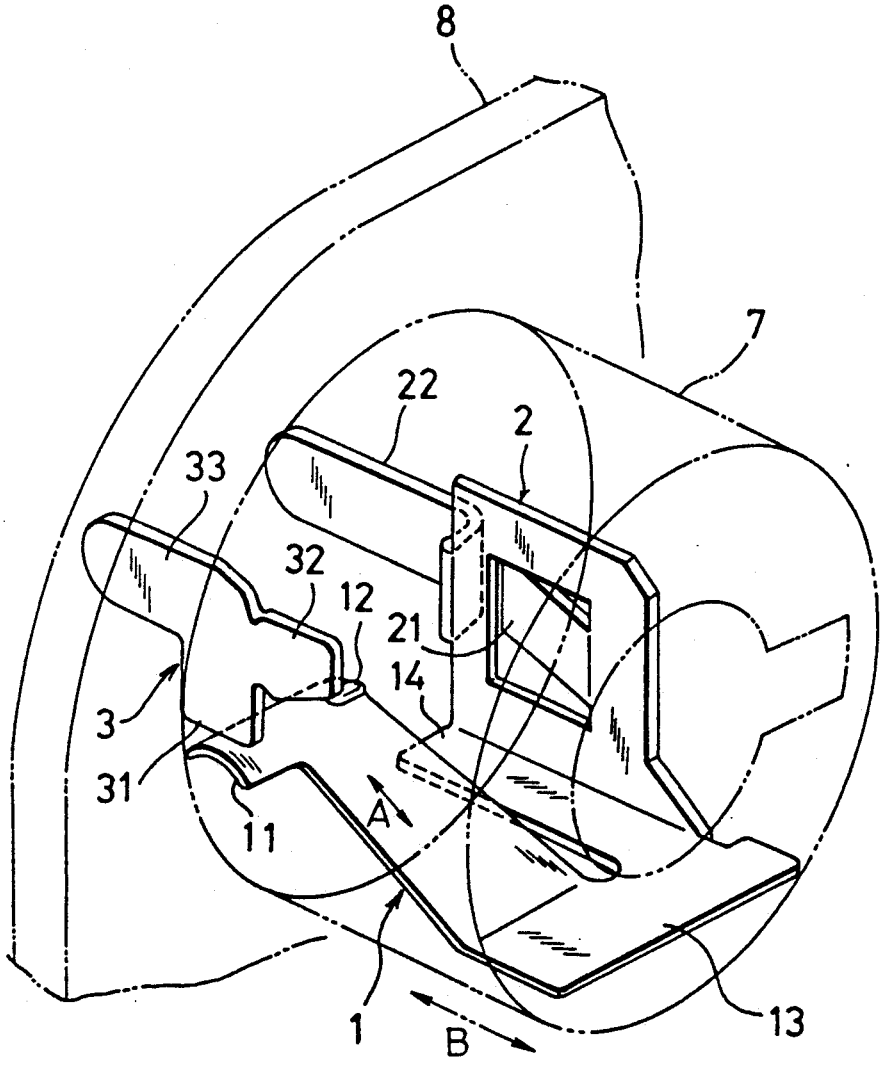
FIG. 1 is an illustrative perspective view of a pin jack in accordance with the present invention.
Figure 2:
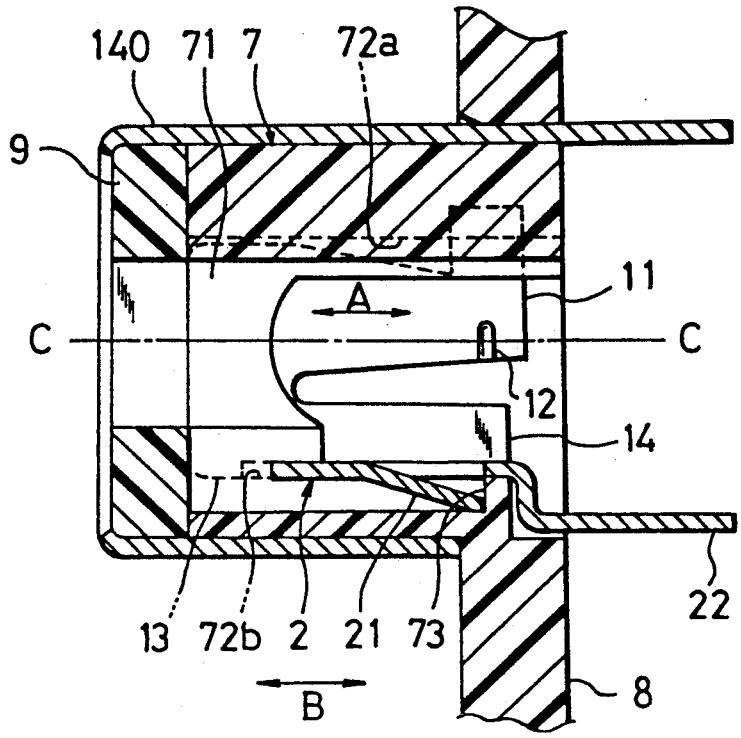
FIG. 2 is a transverse plan view of the pin jack in FIG. 1.
Figure 3:
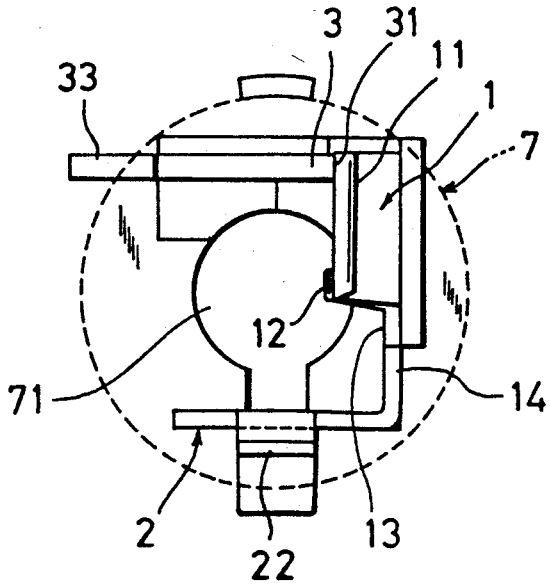
FIG. 3 is an illustrative back view of the pin jack in FIG. 1.

In FIGS. 1 to 3, a movable contact piece 1 is assembled in the inside of a casing body 7 such that the longitudinal direction (extendng in the direction of arrow A) of the movable contact piece 1 is not parallel with but extends along the longitudinal direction (shown by an arrow B) of the casing body 7. The movable contact piece 1 has a wide tip portion 11 having an arcuate section, which obliquely projects inside of a plug insertion space 71 formed by a wall of the casing body inside of the casing body 7. The tip portion 11 of the movable contact piece 1 has a contact 12 adapted to resiliently come in contact with a plug (not shown) inserted into the plug insertion space 71. This contact 12 is disposed at the level of the axis C—C of the plug insertion space 71 as shown in FIG. 2.

A connection piece 13 extends laterally from the base portion of the movable contact piece 1. The connection piece 13 is provided at the end thereof with a projecting piece 14. The lateral edge of the projecting piece 14 is turned upwardly at a right angle to form a stationary piece 2. The stationary piece 2 thus formed is disposed, side by side, laterally of the movable contact piece 1. The stationary piece 2 is rectangular and is shorter than the movable contact piece 1. The stationary piece 2 is provided at the center thereof with an engagement pawl 21 formed as a cut which is raised outwardly raised. This stationary piece 2 is fitted in the casing body 7 from the rear end thereof such that the engagement pawl 21 is engaged with a stepped portion 73 formed in the casing body 7. At the same time, the connection piece 13 is inserted into fitting grooves 72*a*, 72*b* formed in the casing body 7. When the stationary piece 2 and the connection piece 13 are assembled with the casing body 7 in this manner, the tip portion 11 of the movable contact piece 1 is projecting inside of the plug insertion space 71. The engagement of the engagement pawl 21 with the stepped portion 73 prevents the stationary piece 2 from coming out from the casing body 7. At the same time, the stationary piece 2 is held by and between the fitting grooves 72*a*, 72*b*, causing the stationary piece 2 to be securely fixed. Accordingly, the movable contact piece 1 is securely positioned at a predetermined position inside of the casing body 7 by the stationary piece 2. Thus, when a plug is inserted into the plug insertion space 71, the movable contact piece 1 is displaced without being twisted. This stabilizes the contact pressure applied to the contact 12 and the plug. A terminal 22 extends from the rear end of the stationary piece 2.

A stationary contact piece 3 is provided at the end surface with a switch contact 31. The stationary contact piece 3 integrally has a stationary pawl 32 and a terminal 33. In the state where the stationary contact piece 3 is assembled with the casing body 7, when the plug is not inserted into the plug insertion space 71 of the casing body 7, the tip portion 11 of the movable contact piece 1 resiliently comes in contact with the switch contact 31. When the plug is inserted into the plug insertion space 71 to displace the movable contact piece 1, the tip portion 11 of the movable contact piece 1 is separated from the switch contact 31. This stationary contact piece 3 is required for a pin jack having a switch, but is not required for a pin jack having no switching function.

Figure 4:
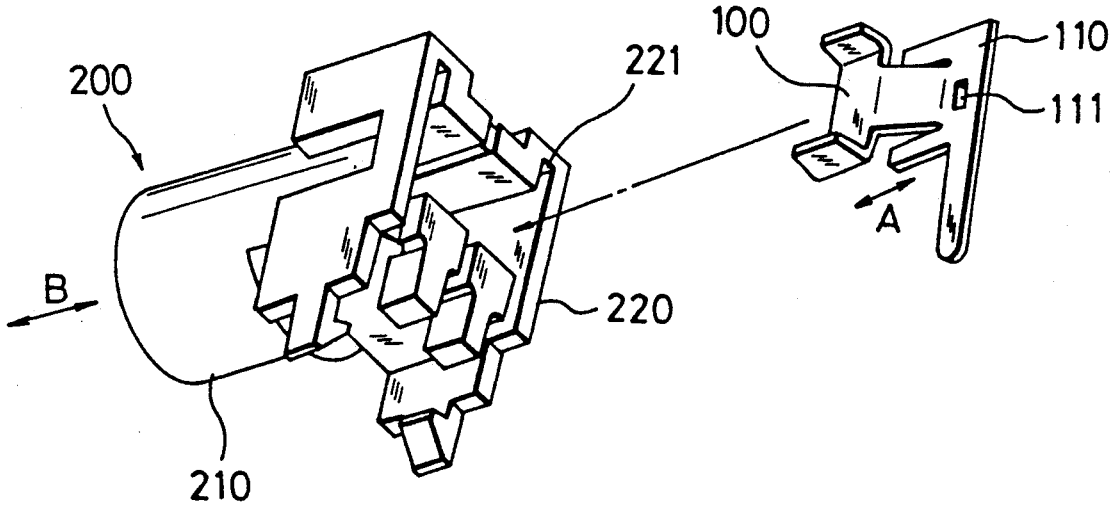
Fig.4 PRIOR ART
FIG. 4 is an exploded perspective view of a conventional pin jack.

In this pin jack, the stationary piece 2, shorter than the movable contact piece 1, is disposed laterally of the movable contact piece 1 and the stationary piece 2 is secured to the inner wall surface of the casing body 7. Accordingly, even though the length of the movable contact piece 1 or the stationary piece 2 is equal to that of the movable contact piece 100 or the stationary piece 110 in the conventional pin jack shown in FIG. 4, the movable contact piece 1 and stationary piece 2 may be housed inside of the casing body 7. Accordingly, the stationary piece 2 may be strongly and securely assembled. To the casing body 7, yet allowing a shortening of the length of the jack body (including the casing body 7 and a jack board 8 integral therewith), as compared with the jack body 200 shown in FIG. 4, by the distance corresponding to the length of the stationary piece housing portion 220. In FIG. 2, a colored washer 9 is held at the front end of the casing body 7 by a grounding contact piece 140 in the form of a casing.

In the embodiment above-mentioned, the movable contact piece 1 is at a right angle to the stationary piece 2, but the angle formed therebetween should not be limited to 90° as far as the stationary piece 2 is disposed laterally of the movable contact piece 1.

What is claimed is:

1. A pin jack for receiving an electrical plug, comprising:

a casing body of insulating material having a wall defining a plug insertion space in said casing body extending along a longitudinal axis of said casing body;

a stationary piece lying in a first plane and having a first lateral edge and secured to said casing body in the insertion space and extending along the longitudinal axis thereof;

a substantially flat connecting piece attached to said stationary piece and extending in a second plane substantially perpendicularly therefrom within the insertion space of the casing body, said connecting piece having a projecting piece having a lateral edge which is connected to said first lateral edge wherein said projecting piece extends substantially parallel to said stationary piece; and a movable contact piece resiliently attached to said connecting piece within the insertion space of the casing body and disposed parallel to the longitudinal axis of the casing body and laterally displaced from said stationary piece and said projecting piece, such that the movable contact piece and the stationary piece are arranged transversely side by side in the insertion space of the casing body, said movable contact piece being placed in the plug insertion space such that it resiliently contacts the plug when the plug is inserted in the plug insertion space.

2. A pin jack according to claim 1, further comprising:

a stepped portion in the wall defining the plug insertion space in the casing body;

a raised engagement pawl extending outwardly from the surface of a said stationary piece, said engagement pawl positioned to engage the stepped portion of the casing body.

3. A pin jack according to claim 2, further comprising:

a stationary contact piece assembled in the insertion space of the casing body, said stationary contact piece being in electrical contact with said moveable contact piece when a plug is not inserted in the plug insertion space and is disconnected from the moveable contact piece when a plug is inserted in the plug insertion space.

4. A pin jack according to claim 1, wherein the stationary piece, the connecting piece and the moveable contact piece are formed from a single piece of electrically conductive material.

5. A pin jack according to claim 1, further comprising:

a stationary contact piece assembled in the insertion space of the casing body, said stationary contact piece being in electrical contact with said movable contact piece when a plug is not inserted in the plug insertion space and is disconnected from the moveable contact piece when a plug is inserted in the plug insertion space.

6. A pin jack for receiving an electrical plug, comprising:

a casing body for insulating material having a wall defining a plug insertion space in said casing body extending along a longitudinal axis of said casing body;

a stationary piece lying in a first plane and having a first lateral edge and secured to said casing body in the insertion space and extending along the longitudinal axis thereof, said stationary piece including a terminal extending outwardly therefrom along the longitudinal axis;

a substantially flat connecting piece attached to said stationary piece and extending in a second plane substantially perpendicularly therefrom within the insertion space of the casing body, said connecting piece having a projecting piece having a lateral edge which is connected to said first lateral edge wherein said projecting piece extends substantially parallel to said stationary piece and attached thereto;

a movable contact piece resiliently attached to said connecting piece within the insertion space of the casing body and disposed parallel to the longitudinal axis of the casing body and laterally displaced from said stationary piece and said projecting piece, such that the movable contact piece and the stationary piece are arranged transversely side by side in the insertion space of the casing body, said movable contact piece being placed in the plug insertion space such that it resiliently contacts the plug when the plug is inserted in the plug insertion space.

* * * * *

UNITED STATES PATENT AND TRADEMARK OFFICE

CERTIFICATE OF CORRECTION

PATENT NO. : 5,239,145

DATED : August 24, 1993

INVENTOR(S) : TOSHIHITO KUSAKABE

It is certified that error appears in the above-identified patent and that said Letters Patent is hereby corrected as shown below:

Claim 1, column 5, line 32, "the" should be --a--, and "a" should be deleted.

Claim 6, column 6, line 14, "for" should be --of--.

Signed and Sealed this

Tenth Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,239,145

DATED : August 24, 1993

INVENTOR(S) : Toshihito Kusakabe

It is certified that error appears in the above-identified patent and that said Letters Patent is hereby corrected as shown below:

Claim 2, column 5, line 32, "the" should be --a--, and "a" should be deleted.

Claim 6, column 6, line 14, "for" should be --of--.

This certificate superseced Certificate of Correction issued May 10, 1994.

Signed and Sealed this

Nineteenth Day of July, 1994

*Attest:*

*Attesting Officer*

Bruce Lehman

BRUCE LEHMAN

*Commissioner of Patents and Trademarks*